US008601997B2

(12) United States Patent
Cockerill et al.

(10) Patent No.: US 8,601,997 B2
(45) Date of Patent: Dec. 10, 2013

(54) WATER PUMP WITH INTEGRATED OIL COOLER

(75) Inventors: Gregory L. Cockerill, Rochester Hills, MI (US); Paul A. Stade, Shelby Township, MI (US); David A. Gorajek, Farmington Hills, MI (US); Chris Springer, Grand Blanc, MI (US)

(73) Assignee: GM Global Technology Operations LLC, Detriot, MI (US)

( * ) Notice: Subject to any disclaimer, the term of this patent is extended or adjusted under 35 U.S.C. 154(b) by 445 days.

(21) Appl. No.: 12/942,257

(22) Filed: Nov. 9, 2010

(65) Prior Publication Data

US 2011/0277707 A1 Nov. 17, 2011

Related U.S. Application Data

(60) Provisional application No. 61/345,392, filed on May 17, 2010.

(51) Int. Cl.
*F02B 67/00* (2006.01)

(52) U.S. Cl.
USPC ..... 123/195 A; 123/41.33; 123/196 AB; 123/198 C; 29/888.02

(58) Field of Classification Search
USPC ..... 123/41.33, 41.31, 41.44, 196 AB, 195 A, 123/198 C; 29/888.02, 888.024, 888.025
See application file for complete search history.

(56) References Cited

U.S. PATENT DOCUMENTS

| | | | | | |
|---|---|---|---|---|---|
| 3,353,590 | A * | 11/1967 | Holman | 165/297 |
| 4,370,957 | A * | 2/1983 | Skatsche et al. | 123/196 AB |
| 4,995,448 | A * | 2/1991 | Inagaki et al. | 165/44 |
| 5,113,807 | A * | 5/1992 | Kobayashi | 123/41.74 |
| 5,477,817 | A * | 12/1995 | Hufendiek et al. | 123/41.33 |
| 5,647,306 | A * | 7/1997 | Pateman | 123/41.33 |
| 5,704,329 | A * | 1/1998 | Bublitz et al. | 123/195 A |
| 6,182,616 | B1 * | 2/2001 | Itoh et al. | 123/41.1 |
| 6,267,094 | B1 * | 7/2001 | Kuettner et al. | 123/196 A |
| 6,394,059 | B2 * | 5/2002 | Guzman | 123/195 R |
| 6,405,689 | B1 * | 6/2002 | Iijima | 123/41.44 |
| 6,978,742 | B2 * | 12/2005 | Miyagawa et al. | 123/41.1 |
| 7,114,926 | B2 * | 10/2006 | Oshita et al. | 416/207 |
| 7,415,946 | B2 * | 8/2008 | Merchant et al. | 123/41.31 |
| 2001/0032610 | A1 * | 10/2001 | Karlsson | 123/196 AB |
| 2006/0213460 | A1 * | 9/2006 | Aoki et al. | 123/41.05 |
| 2008/0006229 | A1 * | 1/2008 | Wilmink et al. | 123/41.33 |

FOREIGN PATENT DOCUMENTS

| | | | |
|---|---|---|---|
| CN | 101435635 | A | 5/2009 |
| DE | 202004011114 | U1 | 11/2005 |
| DE | 102004024516 | A1 | 12/2005 |
| DE | 60127643 | T2 | 7/2007 |
| KR | 1020010007490 | A | 1/2001 |

* cited by examiner

*Primary Examiner* — Noah Kamen
*Assistant Examiner* — Grant Moubry
(74) *Attorney, Agent, or Firm* — Quinn Law Group, PLLC

(57) ABSTRACT

An engine assembly includes a water pump assembly and an oil cooler mounted to the water pump assembly. The water pump assembly includes a rear housing which at least partially defines at least one water passage to fluidly connect the water pump assembly to the oil cooler. A surface is defined by the rear housing and corresponds to a sealing surface on the engine block such that the oil cooler and the water pump assembly are fluidly sealed to the engine block.

19 Claims, 6 Drawing Sheets

WATER PUMP WITH INTEGRATED OIL COOLER

CROSS REFERENCE TO RELATED APPLICATIONS

This application claims the benefit of U.S. Provisional Application Ser. No. 61/345,392 filed May 17, 2010, the entire contents of which are hereby incorporated by reference.

TECHNICAL FIELD

The invention relates to a water pump for an engine, and specifically to a water pump having an integrated oil cooler.

BACKGROUND

A vehicle engine typically utilizes water to cool various engine components and any associated fluids. A water pump is used to move the water through the cooling system. An oil cooler may also be used to cool engine oil that is used for lubricating and cooling the engine. The oil cooler is a heat exchanger which often utilizes the water from the cooling system to cool the oil.

The water inlet and outlet for the oil cooler must be properly located within the cooling system to maintain a sufficient pressure differential to move water through the oil cooler at a sufficient rate for cooling the oil. Likewise, the oil inlet and outlet for the oil cooler must be properly located within the oil lubricating and cooling system to maintain a sufficient pressure differential to move the oil through the oil cooler at a sufficient rate. The oil cooler may typically be located near the engine and the water pump, and fluid lines are typically used to connect the oil cooler to the cooling system and/or the oil system at the proper locations.

SUMMARY

An engine assembly includes a water pump assembly and an oil cooler mounted to the water pump assembly. The water pump assembly includes a rear housing which at least partially defines at least one water passage to fluidly connect the water pump assembly to the oil cooler.

An engine assembly comprises a water pump assembly, an oil cooler fluidly connected to the water pump assembly and an engine block. The oil cooler is mounted to the engine block. The water pump assembly includes a rear housing which defines at least one oil passage to fluidly connect the oil cooler to the engine block. A surface is defined by the rear housing and corresponds to a sealing surface on the engine block such that the oil cooler is fluidly sealed to the engine block.

An assembly comprises a water pump assembly and an oil cooler mounted to the water pump assembly. The water pump assembly includes a rear housing which at least partially defines a first water passage fluidly connected to a high pressure chamber of the water pump assembly and a second water passage fluidly connected to a low pressure chamber of the water pump assembly.

The above features and advantages and other features and advantages of the present invention are readily apparent from the following detailed description of the best modes for carrying out the invention when taken in connection with the accompanying drawings.

DETAILED DESCRIPTION

Figure 1:
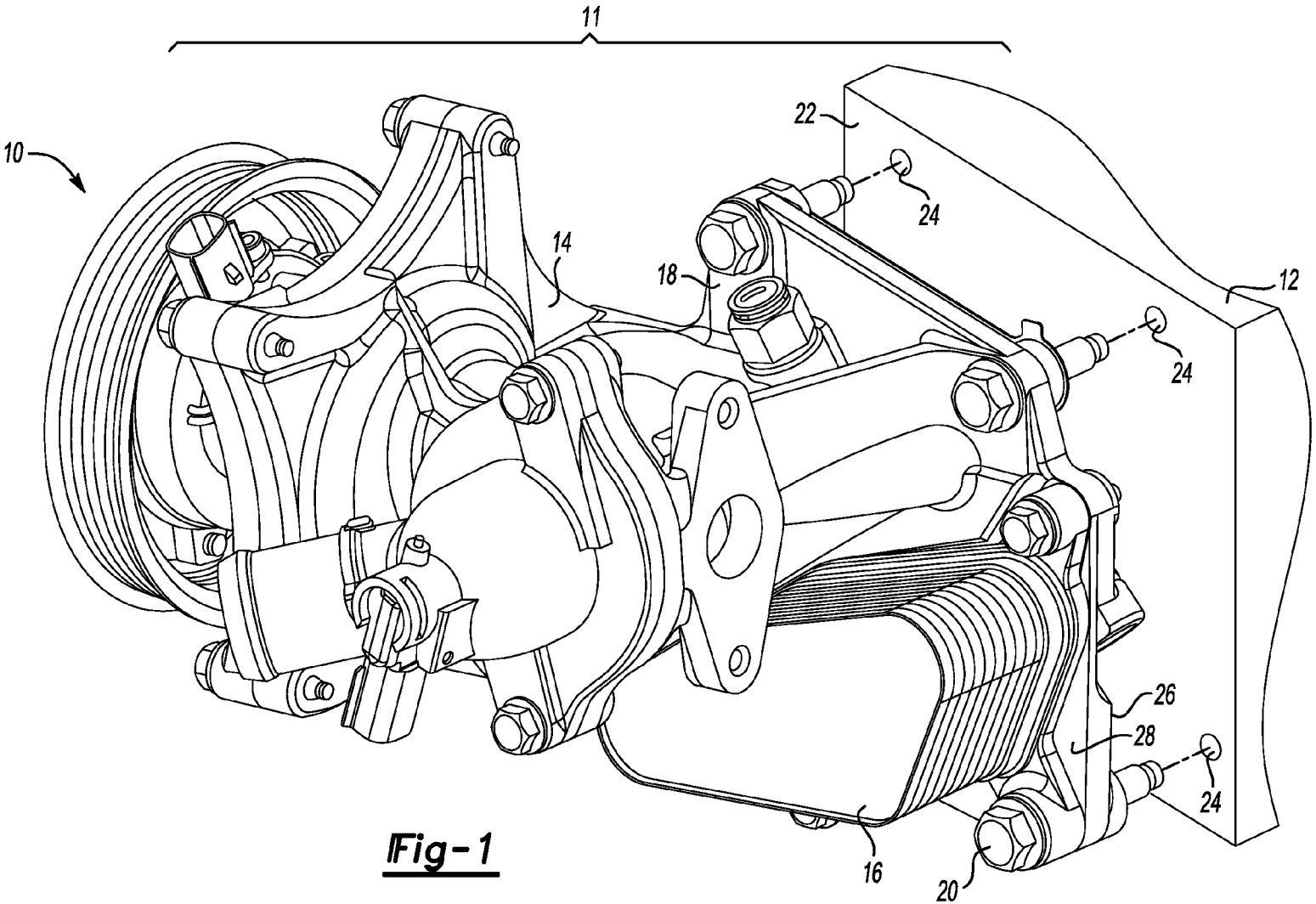
FIG. 1 is a schematic perspective view of a water pump and oil cooler assembly for an engine.
Figure 2:
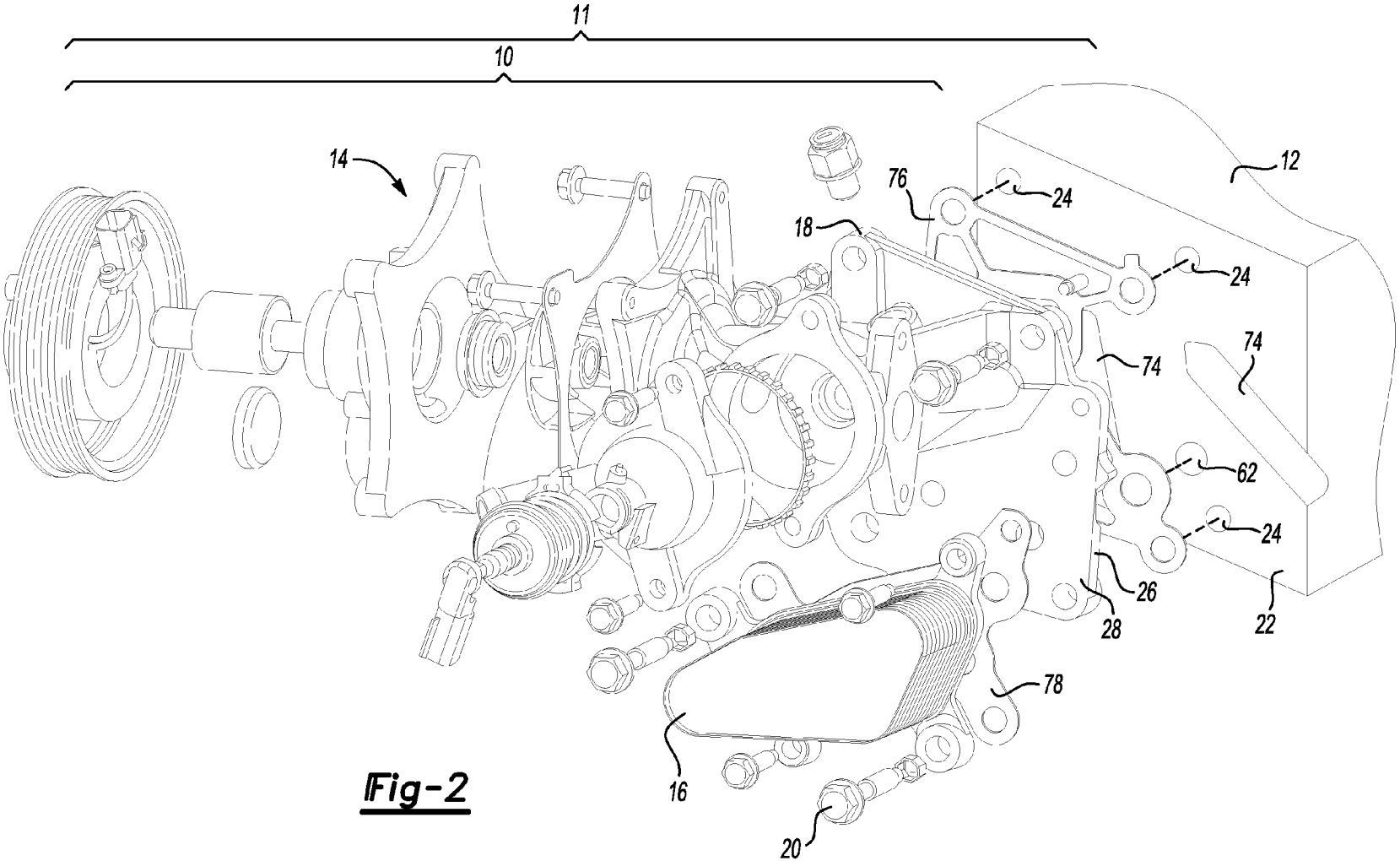
FIG. 2 is a schematic perspective exploded view of the water pump and oil cooler assembly of FIG. 1.

Referring to the drawings wherein like reference numbers refer to like components, FIGS. 1 and 2 illustrate a water pump and oil cooler assembly 10 for mounting to an engine block 12 for an engine 11. The water pump and oil cooler assembly 10 at least partially includes a water pump assembly 14 and an oil cooler 16 mounted thereto. The water pump assembly 14 includes a rear housing 18 that is die cast to form at least a portion of the water pump assembly 14.

A plurality of fasteners 20 are used to secure the water pump and oil cooler assembly 10 to the engine block 12. The engine block 12 may have a engine mounting surface 22 formed thereon for securing the water pump and oil cooler assembly 10 to the engine block 12. The engine mounting surface 22 may provide a generally flat surface to assist in securing and sealing the water pump and oil cooler assembly 10 to the engine block 12. A plurality of fastener holes 24 may be defined by the engine mounting surface 22 to receive the plurality of fasteners 20.

A first mounting surface 26 may be defined by the rear housing 18 for mounting the water pump and oil cooler assembly 10 to the engine mounting surface 22 of the engine block 12. A second mounting surface 28 may also be defined by the rear housing 18 for mounting the oil cooler 16 to the water pump assembly 14. The first mounting surface 26 and the second mounting surface 28 are generally flat surfaces to assist in sealing the water pump assembly 14 to the oil cooler 16 and engine block 12. In the embodiment shown in FIGS. 1 and 2, the first and second mounting surfaces 26 and 28 are located on opposing sides of the rear housing 18 from one another.

Referring to FIGS. 3-6, a first water passage 30, a second water passage 32, a first oil passage 34, and a second oil passage 36 are defined by the rear housing 18. The first water passage 30 is a high pressure water passage. A first water inlet 38 for the first water passage 30 is connected to a high pressure chamber 40 of the water pump assembly 14. A first water outlet 42 is formed on the second mounting surface 28 defined by the rear housing 18. Water from the high pressure chamber 40 enters the first water passage 30 through the first water inlet 38 and flows out of the first water passage 30 and into the oil cooler 16 through the first water outlet 42. The second water passage 32 is a low pressure water passage. A second water inlet 44 is formed on the second mounting surface 28 of the rear housing 18 and a second water outlet 46 is defined by the pump housing 16. The second water outlet 46 is connected to a low pressure chamber 48 of the water pump assembly 14. Water from the oil cooler 16 (shown in FIGS. 1 and 2) flows into the second water passage 32 through the second water inlet 44 and enters the low pressure chamber 48 of the water pump assembly 14. The pressure differential between the first water passage 30 and the second water passage 32 creates sufficient water flow through the oil cooler 16 to cool the oil for the engine 11.

The first oil passage 34 is a high pressure oil passage. A first oil inlet 52 of the first oil passage 34 is connected to a high pressure oil passage 54 from the engine block 12 formed in the engine mounting surface 22. The first oil inlet 52 is defined on the first mounting surface 26 of the rear housing 18 and a first oil outlet 56 is formed on the second mounting surface 28 of the rear housing 16. Oil from the engine block 12 enters the first oil passage 34 through the first oil inlet 52 and flows into the oil cooler 16 from the first oil outlet 56. The second oil passage 36 is a low pressure oil passage. A second oil inlet 58 is formed on the second mounting surface 28 of the rear housing 16 and a second oil outlet 60 is defined on the first mounting surface 26 of the rear housing 18. The second oil outlet 60 is connected to a low pressure oil passage 62, which is defined on the engine mounting surface 22 and leads to an engine sump (not shown). Oil from the oil cooler 14 (shown in FIGS. 1 and 2) flows through the second oil inlet 58 into the second oil passage 36 and flows out through the second oil outlet 60 to enter the engine block 12 through the low pressure input passage 62. The pressure differential between the first oil passage 34 and the second oil passage 36 creates sufficient oil flow through the oil cooler 16 to cool the oil for the engine 11.

Figure 3:
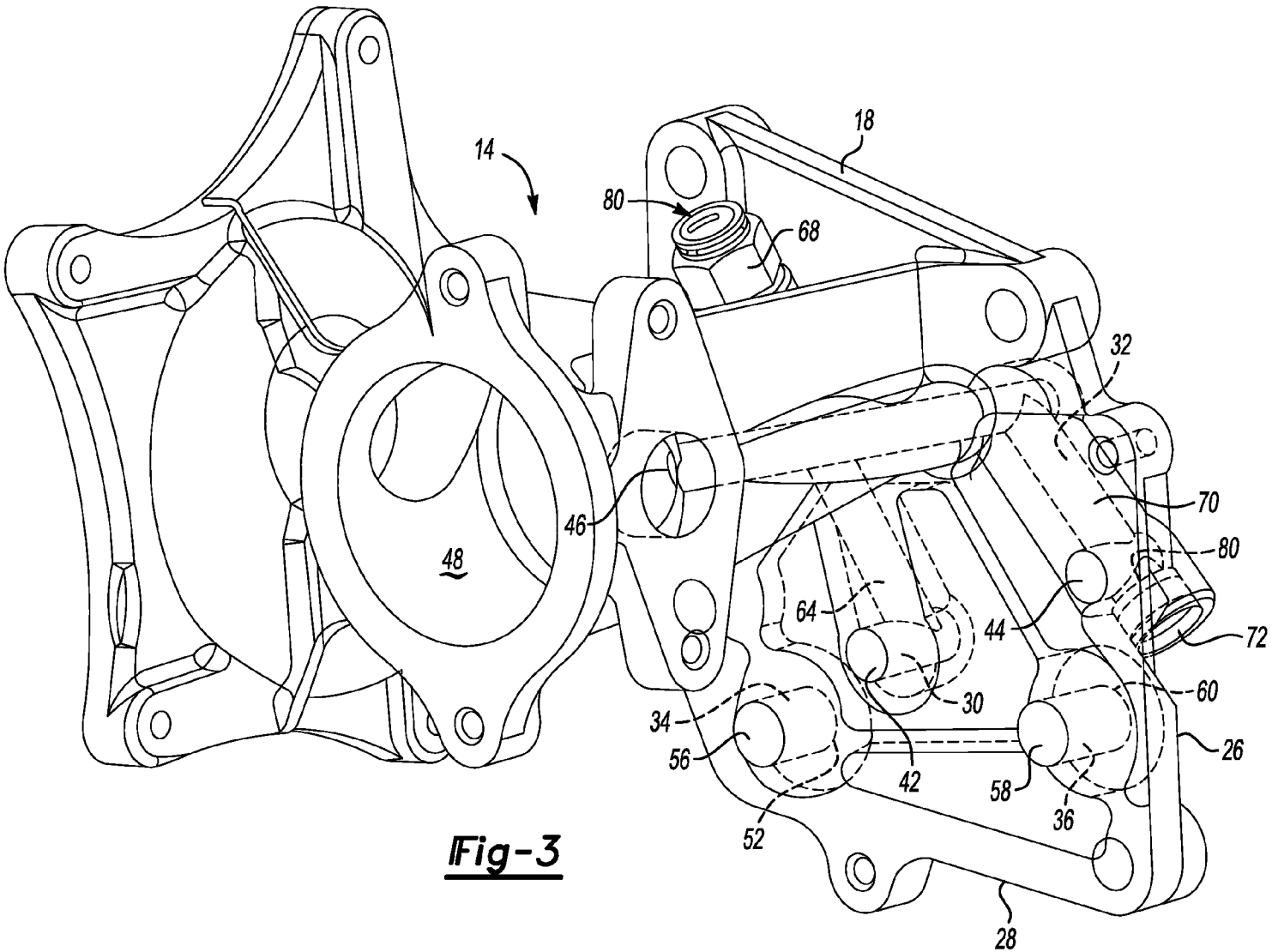
FIG. 3 is a schematic front perspective view of the water pump assembly of FIGS. 1-2.
Figure 4:
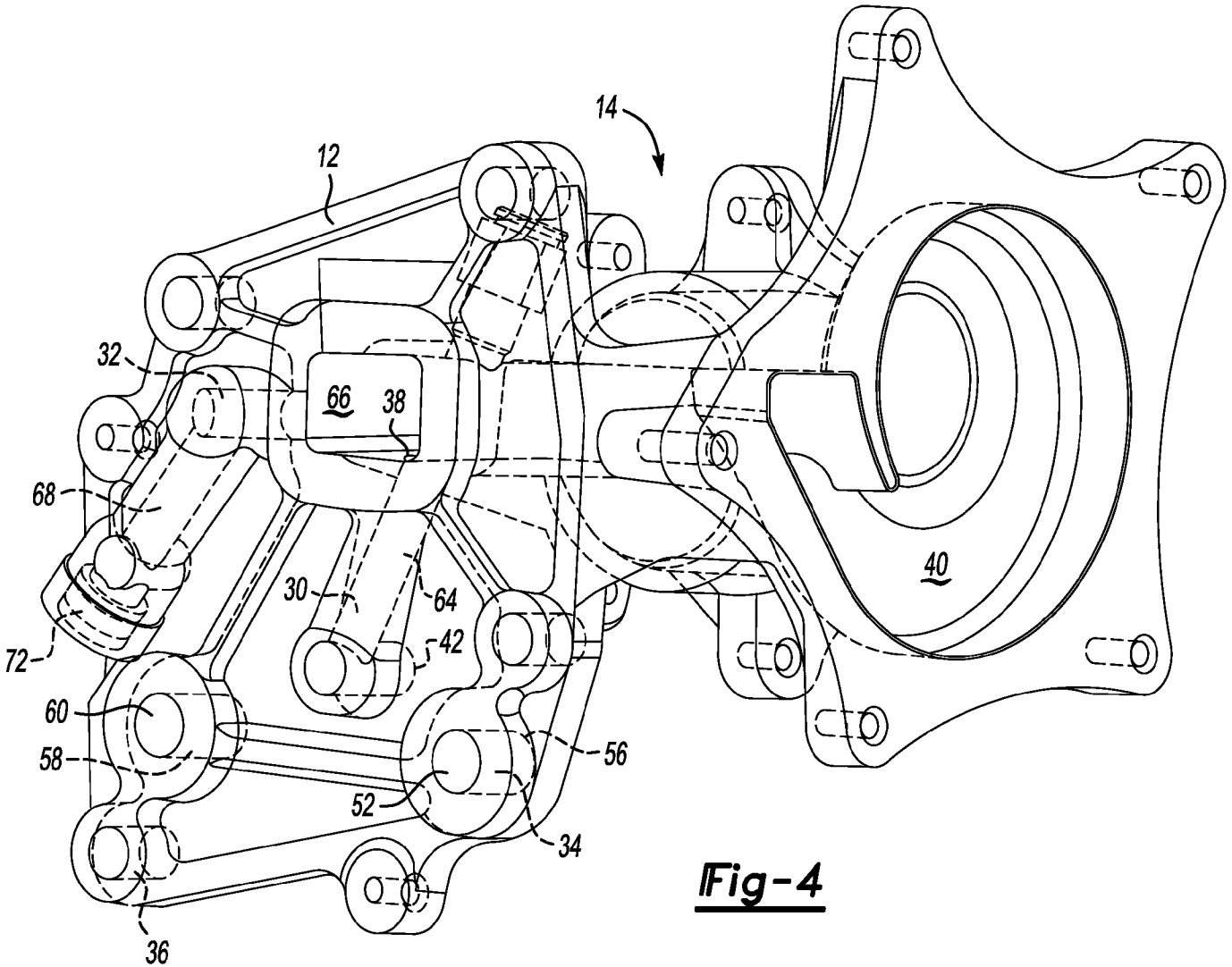
FIG. 4 is a schematic rear perspective view of the water pump assembly of FIGS. 1-3.
Figure 5:
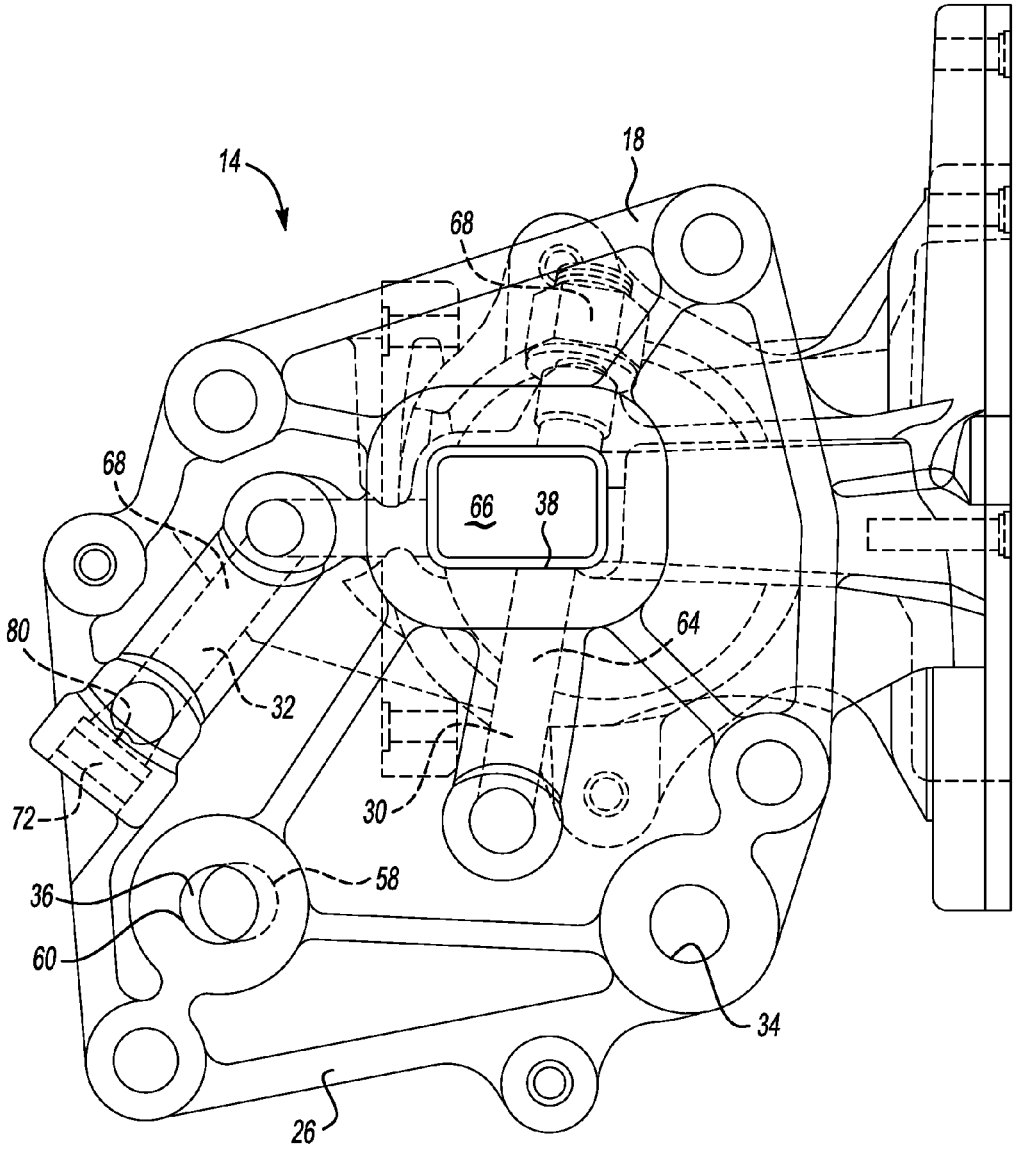
FIG. 5 is a schematic rear side view of the water pump assembly of FIGS. 1-4.
Figure 6:
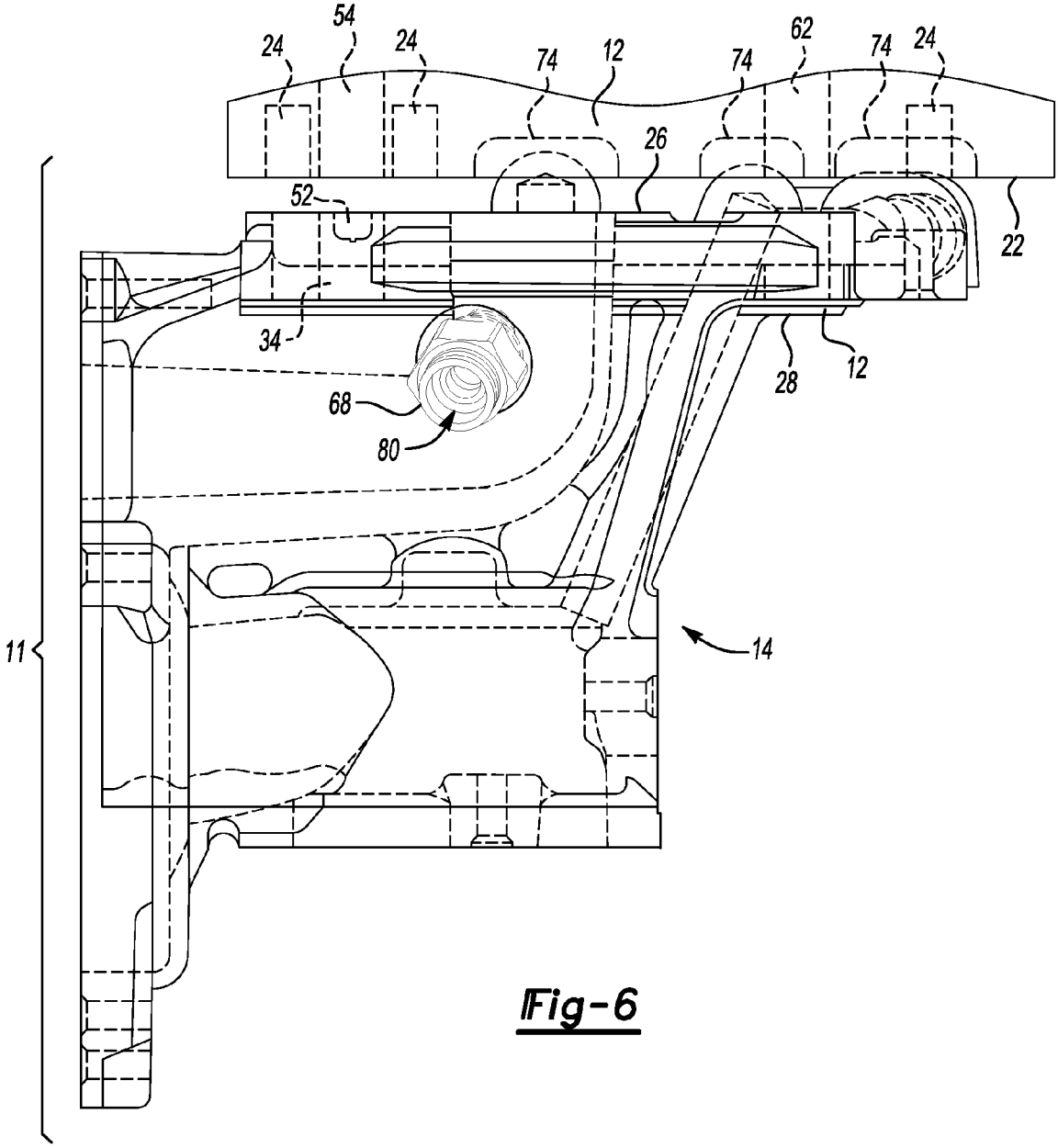
FIG. 6 is a top schematic perspective view of the water pump assembly of FIGS. 1-5.

The rear housing 18 is a die cast housing. Therefore the first water passage 30, the second water passage 32, the first oil passage 34, and the second oil passage 36 may be at least partially formed by drilling the passages into the rear housing 18. The first water passage 30 is a generally U-shaped passage. A first center section 64 is formed by drilling in a generally downward direction in FIGS. 3-6 to connect the two outer portions of the first water passage 30. Referring to FIG. 3, during the drilling process the drill passes through a thermostat chamber 66 for the water pump assembly 14. This creates an opening 80 in the water pump assembly 14 that is not required for the first water passage 30. A fitting 68 is located at the opening 80 in the rear housing 18 created from drilling the first center section 64. The fitting 68 defines an aperture and may be used to fluidly connect another engine component (not shown) to the water pump assembly 14.

Alternatively, a plug may be used in place of the fitting 68 to seal the high pressure thermostat chamber 66 and first water passage 30. Similar to the first water passage 30, the second water passage 32 is also a generally U-shaped passage. A second center section 70, shown in FIG. 3, is formed by drilling the rear housing 18 to connect the two end portions of the second water passage 32. A plug 72 is located at the opening 80 in the rear housing 18 created from drilling the second center section 70. The plug 72 may be used to seal the second water passage 32.

In the embodiment shown, the first oil passage 34 and second oil passage 36 are generally straight passages. However, the first and second oil passages 34 and 36 may take other shapes as necessary to route the oil from the high pressure oil chamber 54 and low pressure oil chamber 62 of the engine block 12 to the desired inlet and outlet locations for the oil cooler 16. Where possible the first water passage 30, the second water passage 32, the first oil passage 34, and the second oil passage 36 should be drilled from an opening already formed on the rear housing 18, or from a location where an opening will be desired. However, as necessary any sections in the first water passage 30, the second water passage 32, the first oil passage 34 and the second oil passage 36 may be formed in a similar manner as the first and second water passages 30 and 32 by drilling a portion of the passage into the rear housing 18 and placing a fitting 68 or a plug 72 at the resultant opening 80 of the rear housing 18 as is desired.

In the embodiment shown, the first water passage 30, the second water passage 32, the first oil passage 34, and the second oil passage 36 are each completely defined by the rear housing 18. Alternatively, only one or more of the passages may be defined by the rear housing 18. A portion of one or all of the passages may also be defined by fluid conduits external to the rear housing 18, such as hoses or pipes. However, the rear housing 18 may be utilized to form at least a portion of at least one of the passages to reduce the complexity for fluidly connecting the engine block 12 and the water pump assembly 14 to the oil cooler 16. Therefore, the oil cooler 16 and water pump assembly 14 may be integrated together and mounted to the engine block 12 while minimizing or eliminating any external fluid conduits between the water pump assembly 14, the oil cooler 16 and the engine block 12.

The first mounting surface 26 is a generally flat surface. However, the first water passage 30, the second water passage 32, the first oil passage 34, and the second oil passage 36 may protrude from the first mounting surface 26. Depressions 74 formed in the engine mounting surface 22 may accommodate any protrusions from the water pump and oil cooler assembly 10 while still providing a generally flat surface for mounting and sealing the water pump and oil cooler assembly 10 to the engine block 12. In the embodiment shown, a gasket 76 (numbered in FIG. 2) is located between the first mounting surface 26 and the engine mounting surface 22 to assist in sealing the first and second oil passages 34 and 36 to the engine block 12. Similarly, a second gasket 78 (numbered in FIG. 2) may be located between the water pump assembly 14 and the oil cooler 16 to assist in sealing the first water passage 30, second water passage 32, first oil passage 34, and second oil passage 36 to the oil cooler 16.

Therefore, the above embodiments disclose an assembly including a water pump assembly 14 and an oil cooler 16 mounted to the water pump assembly 14. A rear housing 18 for the water pump assembly 14 has at least one water passage 30, 32 at least partially defined by the rear housing 18 to fluidly connect the water pump assembly 14 to the oil cooler 16.

While the best modes for carrying out the invention have been described in detail, those familiar with the art to which this invention relates will recognize various alternative designs and embodiments for practicing the invention within the scope of the appended claims.

The invention claimed is:

1. A water pump assembly comprising:

a water pump;

an oil cooler mounted to the water pump;

wherein the water pump includes a rear housing which at least partially defines at least one water passage to fluidly connect the water pump to the oil cooler;

wherein the at least one water passage is a first water passage fluidly connected to a high pressure chamber for the water pump assembly and a second water passage fluidly connected to a low pressure chamber for the water pump assembly; and wherein the first and second water passages are in fluid communication via the oil cooler.

2. The water pump assembly of claim 1, wherein the rear housing is a die cast housing.

3. The water pump assembly of claim 1, wherein the rear housing further defines at least one oil passage to fluidly connect the oil cooler to an engine block.

4. The water pump assembly of claim 1, wherein the rear housing defines an opening in fluid communication with the at least one water passage and configured to receive one of a plug and a fitting.

5. The water pump assembly of claim 4, wherein one of a plug and a fitting is attached to the opening defined by the rear housing.

6. The water pump assembly of claim 5, wherein the fitting defines an aperture such that a conduit may be fluidly connected to the water pump with the fitting.

7. The water pump assembly of claim 1, further comprising a surface defined by the rear housing such that the oil cooler and water pump are fluidly sealed to an engine block with a single seal.

8. An engine assembly comprising:

a water pump assembly;

an oil cooler fluidly connected to the water pump assembly;

an engine block, wherein the oil cooler is mounted to the engine block;

wherein the water pump assembly includes a rear housing which defines at least one oil passage to fluidly connect the oil cooler to the engine block; and wherein the rear housing defines a surface which corresponds to a sealing surface on the engine block such that the oil cooler is fluidly sealed to the engine block.

9. The engine assembly of claim 8, wherein the oil cooler is located on a first side of the rear housing and the engine block is located on a second side of the rear housing, and wherein the at least one oil passage is a through hole defined by the rear housing.

10. The engine assembly of claim 8, wherein the rear housing defines a first oil passage and a second passage, wherein the engine block defines a first passage and a second passage, and wherein a single seal surrounds the first oil passage and the second oil passage to independently fluidly seal the first oil passage and the second oil passage to the first and second passage defined by the engine block.

11. The engine assembly of claim 8, wherein the rear housing defines at least one fastener opening, such that a fastener received by the fastener opening may secure the oil cooler to the rear housing and secure the rear housing to the engine block.

12. The engine assembly of claim 8, the rear housing for the water pump assembly at least partially defines at least one water passage to fluidly connect the water pump assembly to the oil cooler.

13. The engine assembly of claim 12, wherein the at least one water passage is a first water passage fluidly connected to a high pressure chamber for the water pump assembly and a second water passage fluidly connected to a low pressure chamber for the water pump assembly.

14. The engine assembly of claim 12, wherein the rear housing defines an opening in fluid communication with the at least one water passage and configured to receive one of a plug and a fitting.

15. The engine assembly of claim 14, wherein one of a plug and a fitting are attached to the opening defined by the rear housing.

16. An assembly comprising:

a water pump;

wherein the water pump includes a rear housing which at least partially defines a first water passage fluidly connected to a high pressure chamber of the water pump assembly and a second water passage fluidly connected to a low pressure chamber of the water pump;

an oil cooler mounted to a first side of the rear housing;

the oil cooler in fluid communication with the first water passage and the second water passage;

wherein a second side of the rear housing opposes the first side; and wherein the second side defines a surface which corresponds to a sealing surface on an engine block.

17. The assembly of claim 16, wherein the rear housing defines an opening that is in fluid communication with one of the first water passage and the second water passage and configured to receive one of a plug and a fitting.

18. The assembly of claim 17, wherein one of a plug and a fitting are attached to the opening defined by the rear housing.

19. The assembly of claim 18, wherein the fitting defines an aperture such that a conduit may be fluidly connected to the water pump with the fitting.

* * * * *